United States Patent [19]

Morozumi et al.

[11] 4,416,236

[45] Nov. 22, 1983

[54] AIR-FUEL RATIO CONTROL SYSTEM

[75] Inventors: Takuro Morozumi, Mitaka; Hitoshi Suzuki, Niiza, both of Japan

[73] Assignee: Fuji Jukogyo Kabushiki Kaisha, Tokyo, Japan

[21] Appl. No.: 333,194

[22] Filed: Dec. 21, 1981

[30] Foreign Application Priority Data

Dec. 26, 1980 [JP] Japan ..... 55-189095

[51] Int. Cl.[3] ..... F02B 33/00; F02M 7/00

[52] U.S. Cl. ..... 123/438; 261/44 C

[58] Field of Search ..... 261/44 C; 123/440, 439, 123/438

[56] References Cited

U.S. PATENT DOCUMENTS

| | | | |
|---|---|---|---|
| 4,108,121 | 8/1978 | Minami | 123/440 |
| 4,364,354 | 12/1982 | Kosuge | 123/438 |
| 4,377,142 | 3/1983 | Otsuka | 123/440 |

*Primary Examiner*—Ronald B. Cox

*Attorney, Agent, or Firm*—Martin A. Farber

[57] ABSTRACT

An air-fuel ratio control system for an internal combustion engine having a two-barrel carburetor comprising a primary side having a main metering system and a slow speed system and a secondary side having a main metering system. Two on-off electro-magnetic valves are provided for correcting the air to be supplied to air bleeds of both the primary and secondary sides for correcting air-fuel ratio of the air-fuel mixture supplied by the carburetor.

A first passage is provided for connecting the slow speed system of the primary side to one of the electromagnetic valves, a second passage is adapted to connect the main metering system of the secondary side to the one of the electromagnetic valves; and a third passage is provided connecting the main metering system of the primary side to the other electromagnetic valve.

A change-over valve is provided for changing the connection between the electromagnetic valve and first and second passages. The change-over valve is so arranged to normally communicate the electromagnetic valve with the first passage and to communicate the electromagnetic valve to the second passage when the secondary side becomes to operate upon heavy load.

3 Claims, 5 Drawing Figures

AIR-FUEL RATIO CONTROL SYSTEM

BACKGROUND OF THE INVENTION

The present invention relates to an air-fuel ratio control system for emission control system of an internal combustion engine mounted on vehicles, and more particularly to a system for an internal combustion engine provided with a two-barrel carburetor.

The emission control system for purifying exhaust gases by a catalitic convertor with a three-way catalyst is provided with an $O_2$-sensor for detecting the oxygen concentration of the exhaust gases, a feedback control electronic circuit for judging the output of the $O_2$-sensor and for producing a driving output and an electromagnetic valve operated by the driving output for controlling amount of air to be supplied to the carburetor thereby to control air-fuel ratio of the air-fuel mixture to the stoichiometric air-fuel ratio.

The two-barrel carburetor comprises a primary side and a secondary side which is operated in heavy load conditions for increasing the output power of the engine. The secondary side also must operate to control the air-fuel ratio in heavy load conditions. Therefore, electromagnetic valve must be provided for each side. In the control system in which two electromagnetic valves are provided for one side four electromagnetic valves must be provided.

However, the electromagnetic valve is required to act at a high frequency, for example, 40 HZ and to have a high reliable operation and durability. As a result, the electromagnetic valve to meet such requirements is expensive and, in addition, the control system for a plurality of electromagnetic valves is complicated in construction and operation.

Considering now operation ranges of both sides of the two-barrel carburetor, when the engine is operated in the operating range of the primary side, the air-fuel ratio control for the main metering system and slow speed system of the secondary side is not necessary. On the other hand, when the engine is operated in the operating range of the secondary side, the control for the slow speed system in the primary side is not necessary. In addition, the range of the slow speed system in the secondary side is very narrow. Therefore, the air-fuel ratio control for the slow speed system is not always necessary, in view of the fact that fuel is supplied through the main metering system of the primary side.

SUMMARY OF INVENTION

Therefore it is an object of the present invention to provide a system in which air-fuel ratio for the main metering system in the secondary side is controlled with an electromagnetic valve for the slow speed system in the primary side, when the engine is operated in the operating range of the secondary side.

According to the present invention, there is provided an air fuel ratio control system for an internal combustion engine having a two-barrel carburetor comprising a primary side having a main metering system and a slow speed system and a secondary side having a main metering system, an induction passage, a throttle valve provided in each side, an exhaust passage, first detector means for detecting the concentration of a constituent of exhaust gases passing through said exhaust passage, two electro-magnetic valves for correcting the air-fuel ratio of the air-fuel mixture supplied by said carburetor, electronic control circuit comprising a judging circuit for judging an output signal of said first detector means, and a driving circuit for driving said electro-magnetic valves in dependency on an output signal of said first detector means for controlling the air-fuel ratio to a value approximately equal to the stoichiometric air-fuel ratio;

second detector means for producing an output signal when said carburetor changes from primary side operation to the operation by both of the primary and secondary sides, a first passage connecting the slow speed system of said primary side to one of said electromagnetic valves;

a second passage connecting the main metering system of said secondary side to said one of the electromagnetic valves;

a third passage connecting said main metering system of said primary side to the other electromagnetic valve;

an electromagnetically operated change-over valve for changing the connection between said electromagnetic valve and said first and second passages;

said electromagnetically operated change-over valve being so arranged to normally communicate said electromagnetic valve with said first passage and to communicate said electromagnetic valve to said second passage by said output signal of said second detector means.

Other objects and features of the present invention will be fully described with reference to the accompanying drawings.

DETAILED DESCRIPTION OF THE PREFERRED EMBODIMENTS

Figure 1:
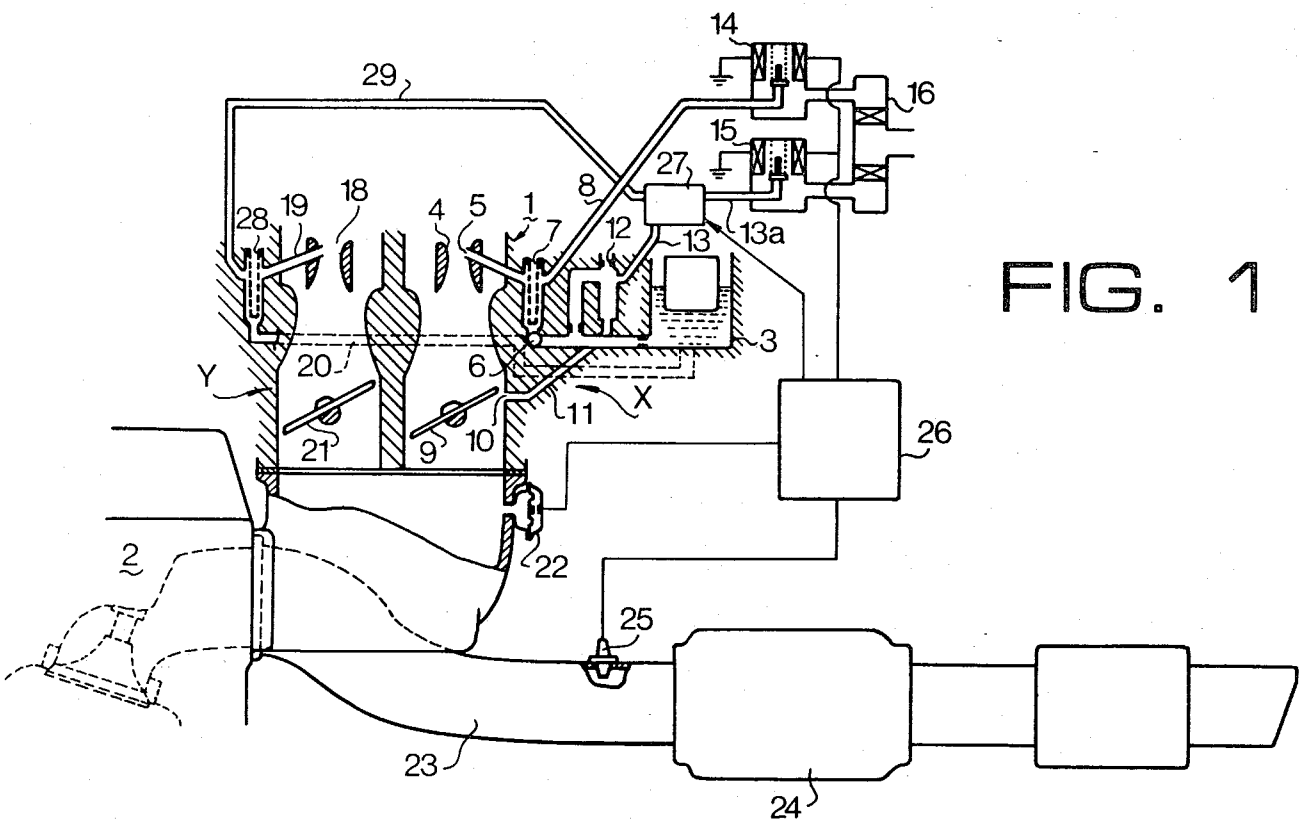
FIG. 1 is a schematic diagram showing an embodiment of the present invention.

Referring to FIG. 1, numeral 1 designates a two-barrel carburetor provided on a body of an internal combustion engine 2, which comprises a primary side X and a secondary side Y. The primary side X comprises a float chamber 3, a main fuel passage 6 communicating the float chamber 3 with a nozzle 5 of a venturi 4, an air bleed 7 communicated with the passage 6, and a correcting air passage 8 communicated with the air bleed 7. A slow-speed port 10 provided adjacent a throttle valve 9 is communicated with an air bleed 12 through a slow-speed fuel passage 11. Further, a correcting air passage 13 is communicated with the air bleed 12 and connected to a change-over valve 27. The change-over valve 27 is connected to an on-off type electromagnetic valve 15 by a passage **13*a* for controlling the air passing through the correcting air passages 13 and 13*a*. The correcting air passage 8 is communicated with an on-off type electromagentic valve 14. Inlets of both the electromagnetic valves 14 and 15 are opened to the atmosphere through an air cleaner 16**.

The secondary side Y comprises a venturi 18, a nozzle 19 and a throttle valve 21. The nozzle 19 is communicated with the float chamber 3 by a passage 20 and an air bleed 28 for the nozzle 19 is communicated with the change-over valve 27 through a passage 29, which in turn communicated with the electromagnetic valve 15.

The throttle valve 21 is adapted to be opened after the throttle valve 9 of the primary side has been opened a predetermined angle or fully opened. A vacuum switch 22 is provided in the induction passage downstream of the carburetor for detecting the load on the engine. In an exhaust pipe 23 of the engine, a catalytic converter 24 with a three-way catalyst is provided. In order to detect oxygen concentration of the exhaust gases, an $O_2$-sensor 25 is provided in the exhaust pipe at the upstream side of the catalytic converter 24.

Outputs of the vacuum switch 22 and $O_2$-sensor 25 are connected to a control circuit 26 which is adapted to control the electromagnetic valves 14 and 15, and the change-over valve 27 as described hereinafter.

Figure 2:
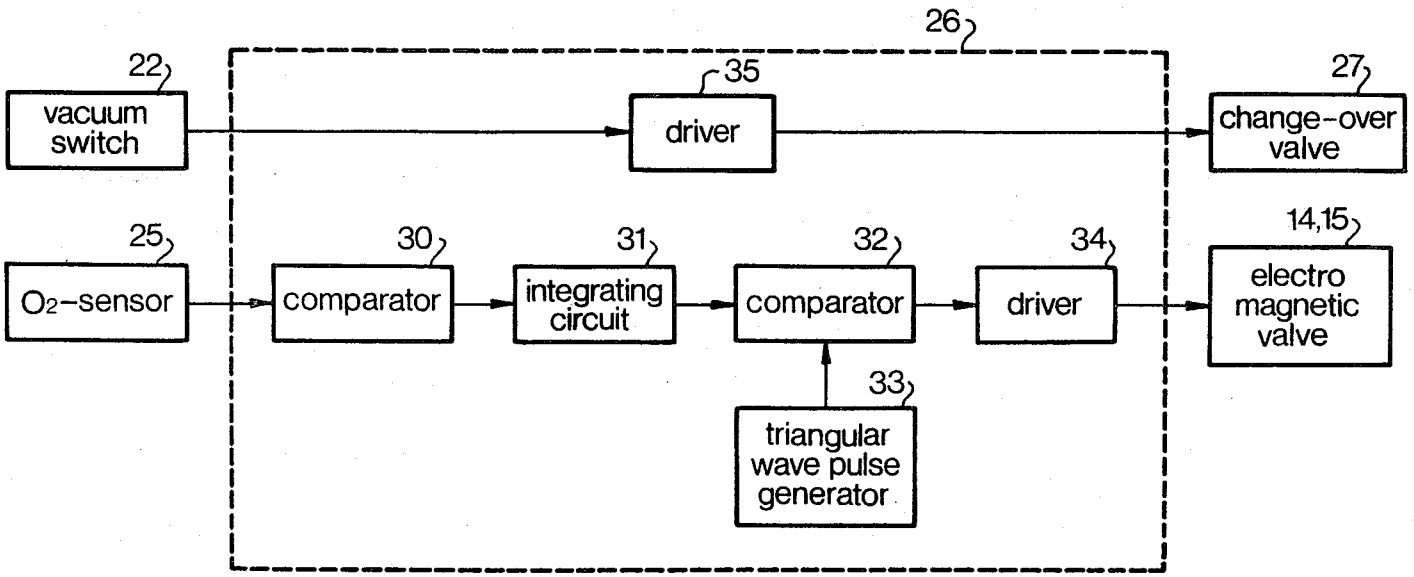
FIG. 2 is a block diagram showing a control circuit according to the present invention.

Referring to FIG. 2 showing the control circuit 26, the output of the $O_2$-sensor 25 is connected to a comparator 30. The comparator compares the input voltage from the $O_2$-sensor 25 with a reference voltage corresponding to the stoichiometric air-fuel ratio for producing an output representing whether the oxygen concentration in the exhaust gases is rich or lean compared with the oxygen concentration to the stoichiometric air-fuel ratio. The output of the comparator 30 is applied to an integrating circuit 31. The integrating circuit produces an output voltage which increases or decreases according to the integration of the input voltage. The output of the integrating circuit 31 is applied to a comparator 32 where the output is compared with a triangular pulse train applied from a triangular pulse generator 33, so that square wave pulses are produced. The duty ratio of the square wave pulse varies in accordance with the output of the integrating circuit 31. The square pulses are applied to electromagnetic valves through a driver 34. Thus, the electromagnetic valves are opened and closed at duty ratios in dependency on the square wave pulses.

The output of the vacuum switch 22 is connected to the change-over valve 27 through a driver 35 for operating the valve.

Figure 3:
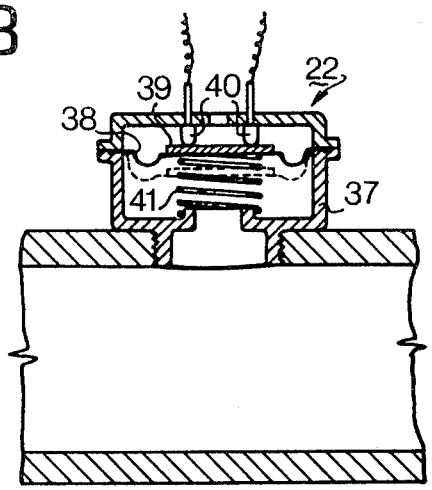
FIG. 3 is a sectional view of a vacuum switch.

Referring to FIG. 3, the vacuum switch 22 comprises a case 37, the inside of which is communicated with the induction passage. The inside of the case 37 is divided into two chambers by a diaphragm 38. The diapragm 38 has a contact plate 39 which is resiliently pressed against a pair of contacts 40 by a spring 41.

Figure 4:
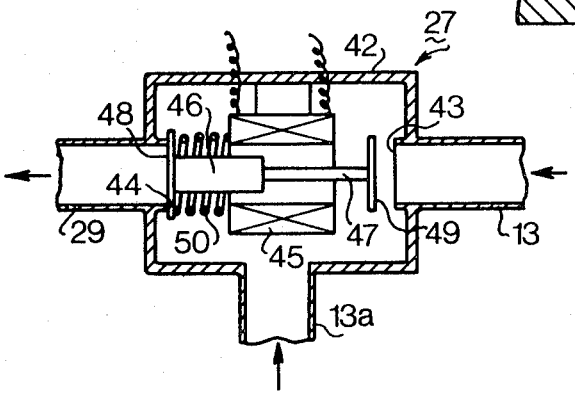
FIG. 4 is a sectional view of a change-over value.

Referring to FIG. 4, the change-over valve 27 has a case 42 having three openings, two openings of which are opposed each other. One of the opposed openings is communicated with the air bleed 28 by the passage 29, and the other is communicated with the air bleed 12 by the passage 13. The other opening is communicated with the electromagnetic valve 15 by the passage 13*a*. The opening of the passage 13 has a valve seat 43 which is to be closed by a valve body 49, and the opening of the passage 29 has a valve seat 44 which is normally closed by a valve body 48. A coil 45 is supported in the case 42 and both valve bodies 48 and 49 are connected by a core 46 and a rod 47 passing through the coil 45. A spring 50 is disposed between the valve body 48 and the coil 45 to normally close the opening of the valve seat 44.

In operation, when the vacuum in the induction passage is higher than a predetermined valve ($-600 \sim -300$ mmHg), the diaphragm 38 of the vacuum switch 22 is biased to the induction passage against the spring 41 by such a high vacuum pressure as shown by dotted lines in FIG. 3. Accordingly, the contact plate 39 is separated from contacts 40. As the switch composed by contacts 40 and contact plate 39 is cut off, the coil 45 of the change-over valve 27 is not excited and the valve body 49 is removed from the valve seat 43. Thus, the passage 13 is communicated with the passage 13*a*, and the passage 29 is closed. Under such condition of the engine, the throttle valve 21 in the secondary side Y is not operated.

The control circuit 26 judges the output of the $O_2$ sensor 25 whether the oxygen concentration of exhaust gases is rich or lean and drives the electromagnetic valves 14 and 15. The operation of the electromagnetic valves 14 and 15 controls the amount of correcting air for the air bleeds 7 and 12 for controlling the air-fuel ratio of the mixture to be supplied to the primary side X. Thus, an air-fuel ratio of the mixtures in the main metering system and slow speed system of the primary side is controlled to the stoichiometric air-fuel ratio.

When the throttle valve 9 of the primary side is widely opened and the throttle valve 21 in the secondary side is also opened, the vacuum in the induction passage becomes lower than the predetermined valve ($-300 \sim 0$ mmHg). Thus, the contact plate 29 is pressed against the contacts 40 by the spring 41 to close the switch. The driving circuit 35 operates to energize the coil 45 of the change-over valve 27, so that the core 46 is moved to the right in FIG. 4. The valve body 49 is abutted on the valve seat 43 to close the valve and to open the opening of the valve seat 44. Thus the passage 13*a* is communicated with the air bleed 28 through the passage to supply the correcting air to the main metering system of the secondary side Y. Accordingly, air-fuel ratio of the mixtures supplied by main metering system of both the primary and secondary sides are controlled by the electromagnetic valves 14 and 15.

Figure 5:
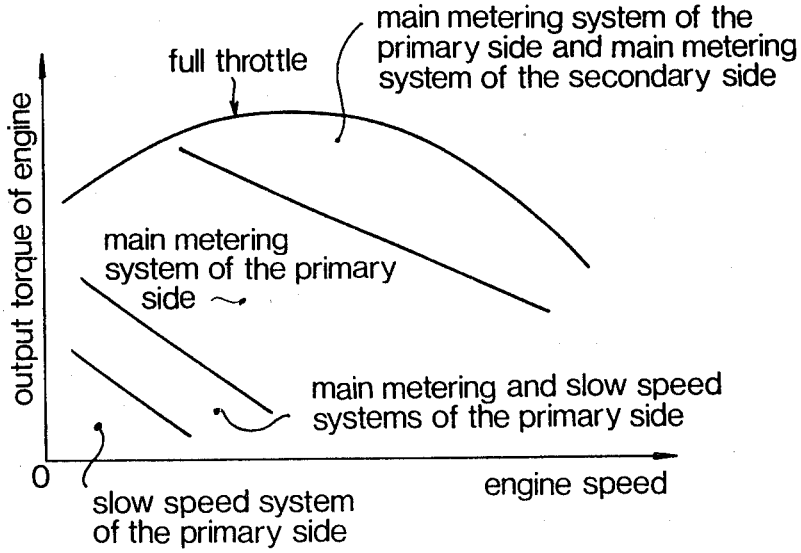
FIG. 5 is a graph showing operating ranges of the primary side and secondary side.

FIG. 5 shows control range of the system. It will be seen that the air-fuel ratio control in the slow speed system of the primary side X is taken place in a range at low engine speed producing low output torque and that the air-fuel ratio control range changes from the slow speed system and main metering system of the primary side to main metering systems of both sides as the engine speed increases.

From the foregoing it will be understood that in accordance with the present invention, two electromagnetic valves are used for controlling the air-fuel ratio of the mixtures supplied to both of the primary and secondary sides of the two-barrel carburetor, whereby the system may be simplified in construction and made at low cost.

What is claimed is:

1. In an air-fuel ratio control system for an internal combustion engine having a two-barrel carburetor comprising a primary side having a main metering system and a slow speed system and a secondary side having a main metering system, an induction passage, a throttle valve provided in each side, an exhaust passage, first detector means for detecting the concentration of a constituent of exhaust gases passing through said exhaust passage, two electromagnetic valves for correcting the air-fuel ratio of the air-fuel mixture supplied by said carburetor, electronic control circuit comprising a judging circuit for judging an output signal of said first detector means, and a driving circuit for driving said electro-magnetic valves in dependency on an ouput signal of said first detector means for controlling the air-fuel ratio to a value approximately equal to the stoichiometric air-fuel ratio;

second detector means for producing an ouput signal when said carburetor changes from a primary side operation to the operation by both of the primary and secondary sides, a first passage connecting the slow speed system of said primary side to one of said electromagnetic valves;

a second passage connecting the main metering system of said secondary side to said one of the electromagnetic valves;

a third passage connecting said main metering system of said primary side to the other electromagnetic valve;

an electromagnetically operated change-over valve for changing the connection between said electromagnetic valve and said first and second passages;

said electromagnetically operated change-over valve being so arranged to normally communicate said electromagnetic valve with said first passage and to communicate said electromagnetic valve to said second passage by said output signal of said second detector means.

2. An air-fuel ratio control system for an internal combustion engine according to claim 1 wherein each of said electromagnetic valves is an on-off type air controlling valve and each of said first to third passages are connected to an air bleed of the carburetor.

3. An air-fuel ratio control system for an internal combustion engine according to claim 1 wherein said second detector means is a vacuum switch adapted to be operated by vacuum in said induction passage.

* * * * *